US010639649B2

(12) United States Patent
Fleuter et al.

(10) Patent No.: US 10,639,649 B2
(45) Date of Patent: May 5, 2020

(54) FEEDBACK CONTROL METHOD FOR THE OPERATION OF A CENTRIFUGE

(71) Applicant: GEA MECHANICAL EQUIPMENT GMBH, Oelde (DE)

(72) Inventors: Markus Fleuter, Ennigerloh (DE); Wilfried Mackel, Lippetal-Herzfeld (DE)

(73) Assignee: GEA MECHANICAL EQUIPMENT GmbH, Oelde (DE)

( * ) Notice: Subject to any disclaimer, the term of this patent is extended or adjusted under 35 U.S.C. 154(b) by 556 days.

(21) Appl. No.: 15/326,091

(22) PCT Filed: Jul. 6, 2015

(86) PCT No.: PCT/EP2015/065353
§ 371 (c)(1),
(2) Date: Jan. 13, 2017

(87) PCT Pub. No.: WO2016/008755
PCT Pub. Date: Jan. 21, 2016

(65) Prior Publication Data

US 2017/0203307 A1 Jul. 20, 2017

(30) Foreign Application Priority Data

Jul. 17, 2014 (DE) ..... 10 2014 110 072

(51) Int. Cl.
*B04B 11/04* (2006.01)
*B04B 13/00* (2006.01)
(Continued)

(52) U.S. Cl.
CPC ..... *B04B 11/04* (2013.01); *B04B 1/2016* (2013.01); *B04B 9/10* (2013.01); *B04B 13/00* (2013.01)

(58) Field of Classification Search
CPC ..... B04B 11/04; B04B 9/10; B04B 13/00; B04B 1/2016
(Continued)

(56) References Cited

U.S. PATENT DOCUMENTS 3,408,001 A * 10/1968 Nilsson ..... B04B 1/08 494/27
5,502,342 A 3/1996 Feldkamp et al.
(Continued)

FOREIGN PATENT DOCUMENTS

DE 1197814 B * 7/1965 ..... B04B 11/043
DE 1197814 B 7/1965
(Continued)

OTHER PUBLICATIONS

DE 4004584 ProQuest Machine Translation.*
(Continued)

*Primary Examiner* — Walter D. Griffin
*Assistant Examiner* — Shuyi S. Liu
(74) *Attorney, Agent, or Firm* — Patent Portfolio Builders PLLC

(57) ABSTRACT

A feedback control method accounts for noise emissions of a centrifuge for the operation of a centrifuge, in particular a separator or a decanting centrifuge, for the centrifugal processing of a product, in particular for clarifying a product and/or for separating a product into different liquid phases using the drum.

14 Claims, 5 Drawing Sheets

Figure 1:
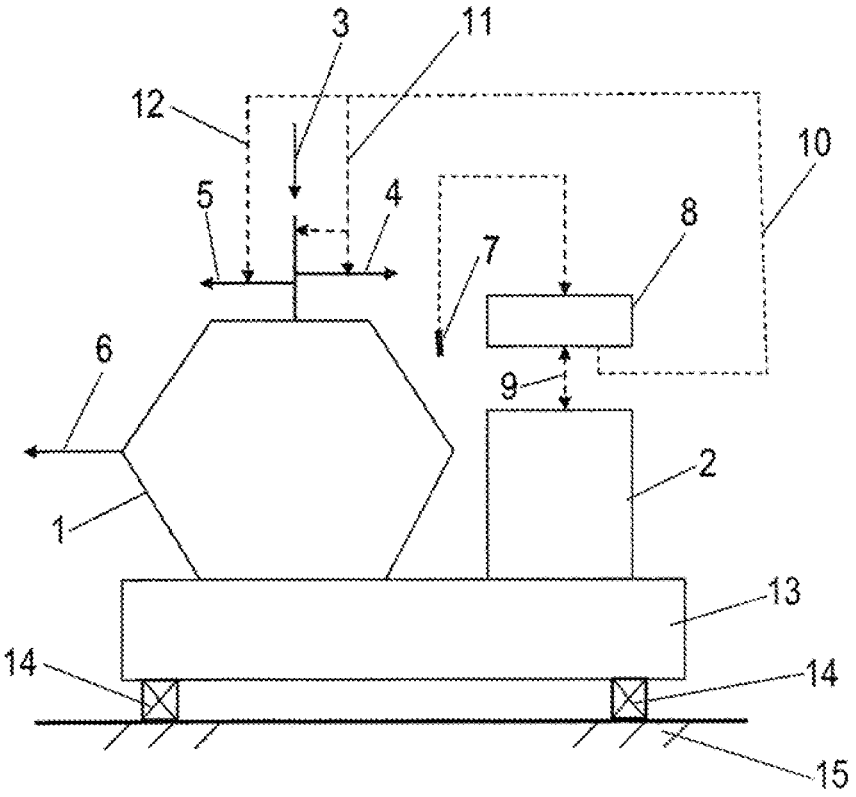

(51) Int. Cl.
*B04B 1/20* (2006.01)
*B04B 9/10* (2006.01)

(58) Field of Classification Search
USPC ..... 494/1, 7, 10, 82
See application file for complete search history.

(56) References Cited

U.S. PATENT DOCUMENTS

| | | | | |
|---|---|---|---|---|
| 5,736,054 | A | 4/1998 | Feller et al. | |
| 5,879,279 | A * | 3/1999 | Berger | B04B 9/146 494/11 |
| 5,948,271 | A * | 9/1999 | Wardwell | B04B 1/20 210/143 |
| 7,028,226 | B2 | 4/2006 | Fleuter | |
| 2013/0012371 | A1* | 1/2013 | Marro | B04B 9/10 494/6 |

FOREIGN PATENT DOCUMENTS

| | | | | |
|---|---|---|---|---|
| DE | 108467 | | 9/1974 | |
| DE | 4004584 | A1 * | 8/1991 | B04B 3/00 |
| DE | 4004584 | A1 | 8/1991 | |
| DE | 4315694 | A1 | 11/1994 | |
| DE | 4327291 | A1 | 2/1995 | |
| DE | 10024412 | A1 | 11/2001 | |
| WO | 9720634 | A1 | 6/1997 | |
| WO | WO-2014089749 | A1 * | 6/2014 | G06F 1/3206 |

OTHER PUBLICATIONS

DE 1197814 ProQuest Machine Translation.*
German Search Report dated Apr. 9, 2015 in related DE Application No. 10 2014 110 072.7.
International Search Report dated Sep. 21, 2015 in related International Application No. PCT/EP2015/065353.
"Sixth General Administrative Procedure for the Federal Immission Control Act (Technical Instructions for the Protection against Noise—TA Noise)," Aug. 26, 1998, http://www.verwaltungsvorschriften-im-internet.de/bsvwvbund_26081998_IG19980826.htm.
Written Opinion dated Sep. 21, 2015 in related International Application No. PCT/EP2015/065353.

* cited by examiner

FEEDBACK CONTROL METHOD FOR THE OPERATION OF A CENTRIFUGE

BACKGROUND AND SUMMARY OF THE INVENTION

Exemplary embodiments of the invention relate to a method for controlling the operation of a centrifuge with a rotatable drum, in particular a separator or a decanter, in the centrifugal processing of a product, in particular in a clarifying of a product and/or in a separating of a product into different liquid phases with the drum.

Such methods are known per se from the prior art, thus from German patent document DE 100 24 412 Al or PCT International patent document WO 97/20634. German patent document DE 40 04 584 A1 discloses evaluating noise development of the centrifuge in the controlling of the separation process for optimization of the separation process.

With respect to this prior art, a further method is to be created for the operation of a centrifuge, which enables optimized modes of operation compared to the prior art.

According to an exemplary embodiment, in the controlling of the operation of the centrifuge the noise development of the centrifuge is controlled, by a. at least one noise level limit being defined,
b. during operation, i.e., during a rotating of the drum of the centrifuge, the noise development of the centrifuge being measured by a sensor device,
c. the data measured by the sensor device being passed on to a control device, by which the measured data are compared to target data, and by which, using this comparison, at least one correcting variable is determined, and
d. with the control device, using the at least one correcting variable or using a plurality of correcting variables, the operation of the centrifuge is influenced so that the noise development does not exceed the at least one noise level limit.

In such a way, the ongoing operation of the centrifuge is optimized in the centrifugal processing of a product, wherein the focus is not or only marginally an error detection, but rather a minimizing of the noise development as a function of at least one or more predetermined limits.

An optimization of the noise development as a function of predetermined noise development limits means, in particular, the reduction of the noise emission or respectively the reduction of the loudness of the centrifuge as a function of predetermined limits. Here, by way of example, the sound pressure level is named as a measurement. The sound pressure is measured here in μPa and is set in relation to a reference sound pressure level $p_0$=20 μPa=$2\times10^{-5}$ Pa, so that it can be indicated in dB (decibels). Further conceivable physical values as a basis for the reduction of the sound intensity of the centrifuge are, however, also the sound power level (indicated in dB), the loudness (indicated in "sone"), the sound intensity in phon, or evaluated sound pressure—or respectively sound power level. The A-weighted sound level is based here, for example, in a frequency-dependent manner on human hearing with correction factors, in order to be able to better replicate the perceived sound intensity. The calculation of the total sound pressure level then takes place.

The sound pressure level $L_p$ is calculated here according to the following formula:

$L_p=20\log_{10}(p/p_0)$ dB, wherein p stands for the measured pressure and $p_0$ stands for the reference sound pressure level.

Example: Correction factors k for an A-weighted sound measurement:

| | Frequency [Hz] | | | | | | | |
|---|---|---|---|---|---|---|---|---|
| | 100 | 200 | 400 | 1000 | 2000 | 4000 | 8000 | 12000 |
| Correction factor k [dB] | −19.1 | −10.9 | −4.8 | 0 | +1.2 | +1.0 | −1.1 | −4.2 |

The sum sound pressure level is calculated here according to the following formula:

$$L=10\times\log_{10}((p_1^2+P_2^2+\ldots+p_n^2):(p_0^2))$$

The invention is described in further detail below with reference to the drawings by means of an example embodiment.

BRIEF DESCRIPTION OF THE DRAWING FIGURES

Figure 2B:
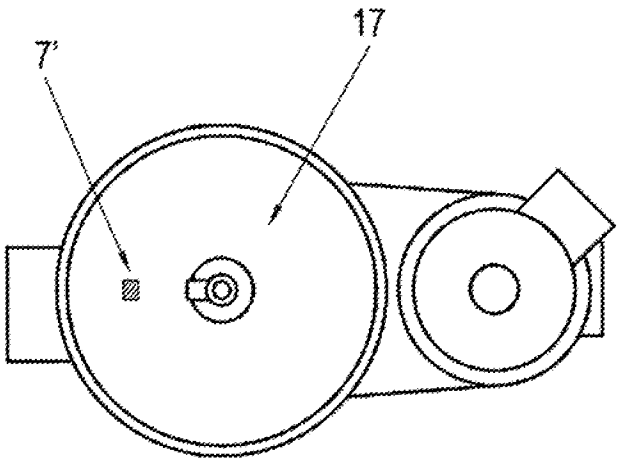
Figure 2A:
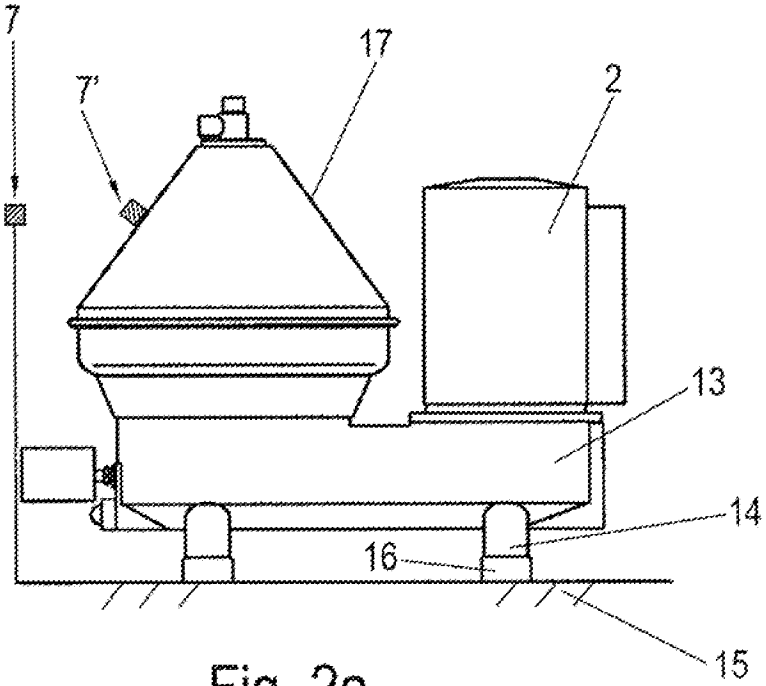
Figures 3A, 3B:
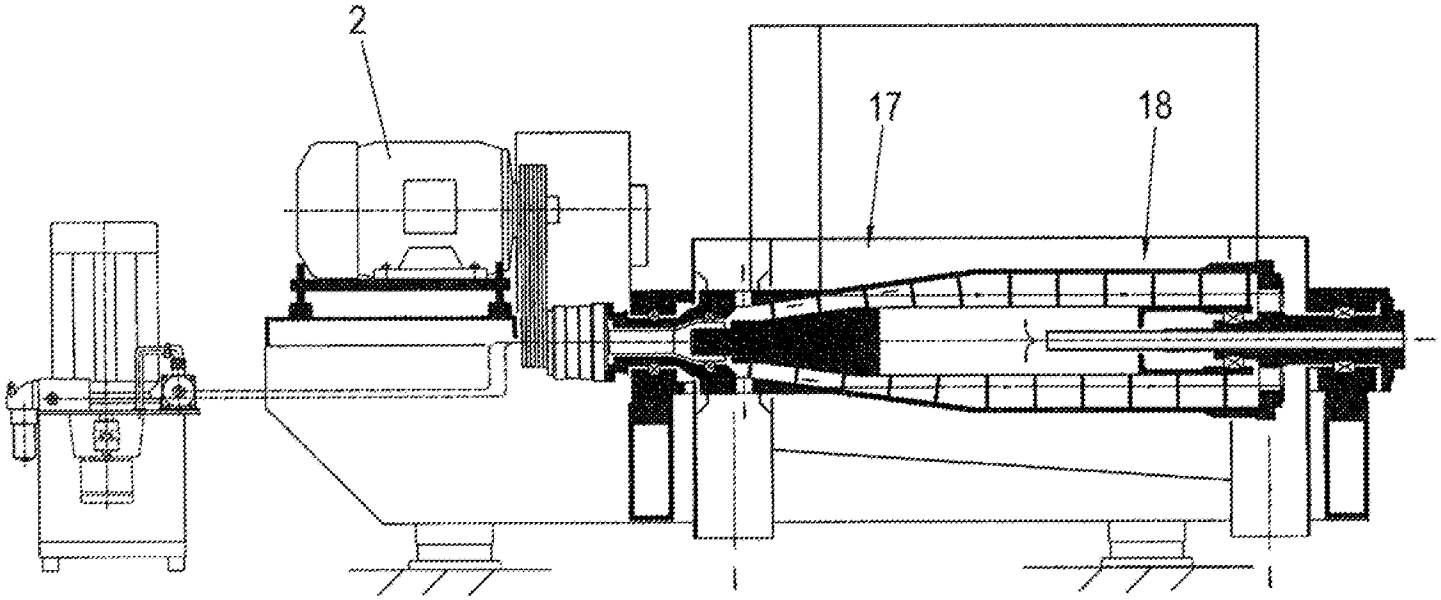

FIG. 1 shows a diagrammatic illustration of a separator for the centrifugal processing of a product, FIG. 2*a* and *b* show two views of a further separator for the centrifugal processing of a product; and FIG. 3*a* and *b* show two views of a decanter for the centrifugal processing of a product.

Figure 4A:
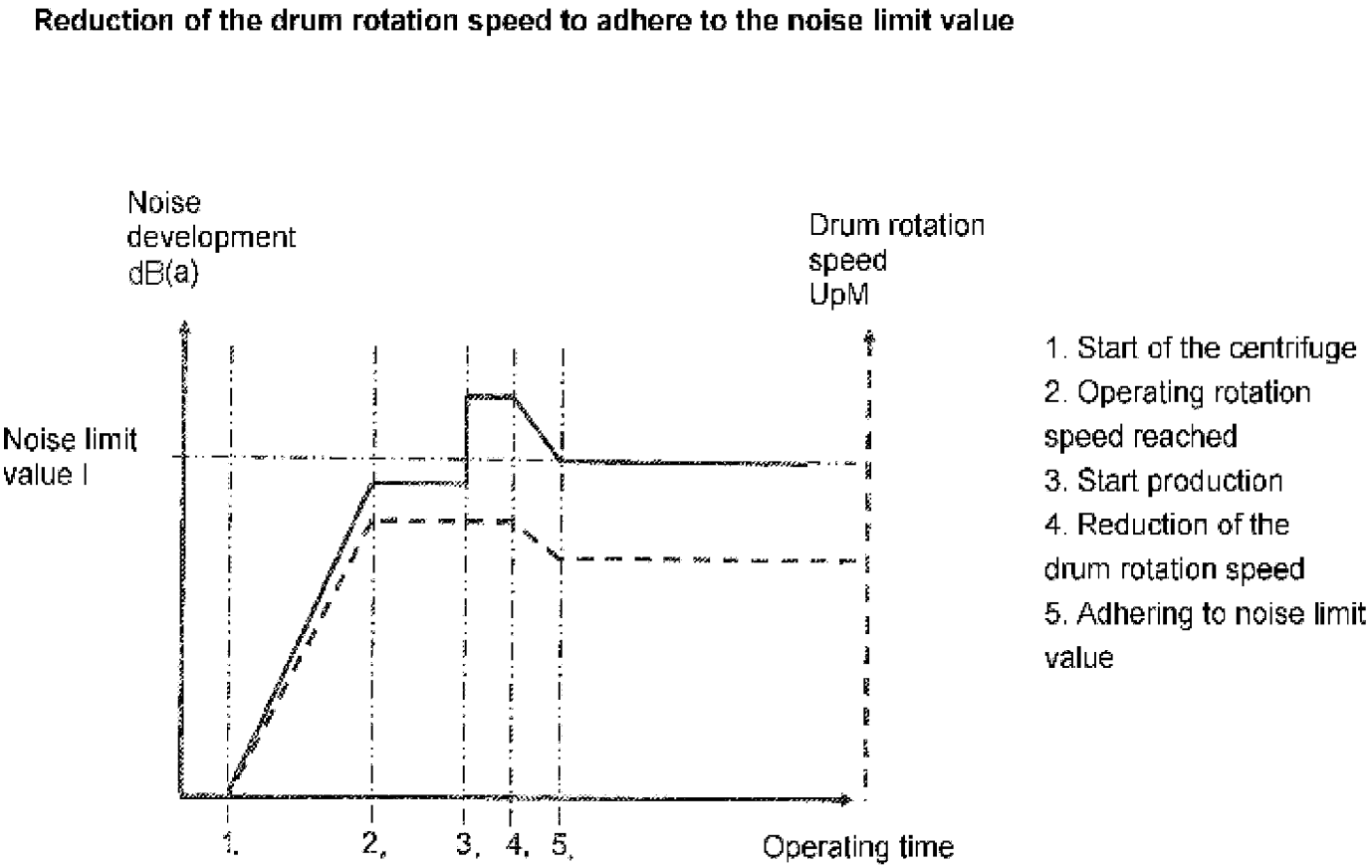

FIG. 4*a* and *b* show two diagrams, which illustrate a noise reduction by means of variants of methods according to the invention.

DETAILED DESCRIPTION

FIG. 1 shows a diagrammatic illustration of a separator for the centrifugal processing of a product, in particular for clarifying a product of solids (or for concentrating such a phase) and/or for separating a product into different liquid phases.

The separator illustrated in FIG. 1 has a rotatable drum 1 (only illustrated schematically here), with a preferably vertical rotation axis, which has a drive spindle (not illustrated here), which can be driven via a drive connection (likewise not illustrated here) with a motor 2. A supply line 3 leads into the drum 1. Liquids of different density and, if applicable, solids, can be directed out from the drum through one or more discharge lines 4, 5 and, if applicable, solids discharge openings 6. In the supply line 3 and the discharge line(s) 4 and 5, valves are provided (not illustrated here), which are preferably controllable (and preferably able to be throttled).

The rotatable drum 1 and preferably the drive/motor 2 are arranged on a machine frame 13. The machine frame 13 is, in turn, mounted on a base 15 via one or more foot elements 14, which may have a spring or can be constructed as such. In FIG. 2, this spring is illustrated as a block 16.

During operation, i.e., during rotation of the drum 1, the noise development of the centrifuge, in particular in the vicinity of the drum 1, is measured with a suitable sensor device, in particular with a microphone 7. This measuring takes place in ongoing manner continuously, or at intervals. The data measured by the sensor device are passed on to a control device 8 (which has, inter alia, a computer), where they are evaluated. Thus, respectively, only the sound level can be measured. However, it is also conceivable to receive and evaluate a frequency spectrum. In FIG. 2 a microphone 7 is also illustrated and alternatively a sensor 7' for measurement directly on a cover of a separator.

The measurement data are then compared with target data. At least one correcting variable is determined using this comparison. The control device 8 uses the at least one correcting variable (or several correcting variables) to influence the operation of the centrifuge so that the control variable—the noise development—is altered so that it assumes a desired behavior.

Thus, it is conceivable to feed to the motor or respectively its control, for example to a frequency converter 2, via a line 9 (or wirelessly), a signal influencing the rotation speed of the drive spindle of the drum 1, in order to alter the rotation speed of the drive spindle, in order to alter in such a way the noise development of the separator, in particular to reduce it.

It is also conceivable to include further parameters into the control. Thus, in addition to the rotation speed, factors influencing noise development are the feed 3 and/or the outlet pressures into the outlets 4, 5 and/or the emptying amount/emptying frequency via the outlet 6 of the drum 1. Thus, the noise development on emptying operations, e.g., by means of a piston slide valve at discharge openings—with a smaller volume is less than in emptying operations of solids with a greater volume.

For this, however, emptying operations are necessary more frequently, in order to achieve overall the intended emptying volume.

For this, it is advantageous to actuate devices, in particular valves, which are able to be actuated via data lines (or wirelessly) 10, 11, 12, in the discharge lines 4, 5, 6 such that the throughflow behavior in the corresponding supply and discharge lines is altered so that the noise behavior (within a predetermined noise level window) is optimized as desired.

Particularly preferably, the airborne sound transmitted by the centrifuge and surrounding machine parts and/or by a gas surrounding the drum is determined by the sensor device. Alternatively, the structure-borne sound could also be detected. The preferably detected frequency band both for the airborne sound measurement and also for the structure-borne sound measurement is 50-12000 Hz, preferably 50-8000 Hz, most particularly preferably 50-5000 Hz.

Thus, it is in fact known from the prior art, for example to sense the vibration behavior of centrifuges using deflections of the drive spindle. On the other hand, it was not recognized that the noise development presents a simple possibility for controlling the operation of the centrifuge, which offers other and/or further advantages compared to the prior art.

For example, it is conceivable to define one or more upper noise level limits I and II, and to operate or respectively control the machine so that depending on the time of day, one or other of the limits is adhered to, for example in order to adhere to noise regulations which stipulate a quieter operation at night than during the day.

Preferably, the outlet pressures, the volume flow that is to be processed, the emptying amount, the emptying frequency, and the rotation speed of the drum are controlled as correcting variables. If, for example, a separator MSE 500 at 50 $m^3$/h and 6 bar outlet pressure generates a sound pressure of 84 dB(A) (measured by way of example at 1 m distance), this delivers during operation with 35 $m^3$/h and 4.5 bar outlet pressure a distinctly reduced sound pressure of only 80 dB(A). The control of the noise level is preferably supplemented by a control of further variables, for example control of the turbidity using a turbidity measurement in the outlet for determining the degree of separation.

It is preferred that the noise level measurement takes place in intervals which are less than or equal to 1 h, preferably less than or equal to 10 min, in particular less than or equal to 1 min. However, it is also conceivable to carry out the measurement more infrequently, for example only when a change to the noise level is desired after a predetermined time of day.

The method according to the invention is suitable for the operating of a centrifuge, in particular a separator with vertical rotation axis in continuous operation, which has a separation means such as a separation disk set in the drum. Alternatively, the centrifuge can be constructed in a different manner, for example as a solid bowl screw-type centrifuge, in particular with a horizontal rotation axis (not illustrated here).

By suitable selection of the distance of the sensor device to the centrifuge, an influence can be carried out as to whether more or fewer noise influences from the environment also enter into the measurement. The conventional distance to the surface of 1 m is, for example, set at less than 1 m here, in particular less than 50 cm, particularly preferably at less than 30 cm.

It is also conceivable to detect the environmental noises and the noises of the centrifuge with two sensor devices such as microphones, which are preferably directed in different directions, in particular offset through 180°, and to use these for evaluation. Thus, the difference of the noise development between the environment and the centrifuge could be determined, because in the environment generally there are further machines such as mills or pumps, which influence the noise development. It is also conceivable to also include environmental machines into the noise-dependent regulation/control.

When structure-borne sound is measured, this measurement, preferably sensing on the oscillating system of the centrifuge will take place at a location that can oscillate particularly intensively, for example on the cover. The machine itself must be insulated from the environment via one or more dampers. In such a way, the influence of the structure-borne sound from the environment on the measurement of the noise development can be minimized. FIGS. 2 and 3 illustrate this by the example of a separator (FIG. 2) with vertical rotation axis with a structure-borne sound sensor 7' (or respectively-receiver, in particular an electroacoustic transducer for structure-borne sound measurement) for measurement of the structure-borne sound on the oscillating system, here on a cover 17 surrounding the drum, which is particularly well suited for this. Other locations on the separator with vertical rotation axis or on a decanter (solid bowl screw-type centrifuge) 18 with horizontal rotation axis 19.

According to the variant, illustrated in FIG. 4*a*, of a method according to the invention, a noise level threshold value I is to be adhered to or respectively as far as possible not or if only briefly exceeded. First, a noise level threshold value I is set. In operation, the structure-borne sound and/or the air-borne sound is determined for measuring the noise development of the centrifuge, and namely here preferably using a microphone or several microphones 7 as sensor device. As can be seen in FIG. 4*a*, the noise level threshold value I on running up to a nominal rotation speed (operating instants 1. to 2.) and then in idling (ready for operation, operating instants 2. to 3.) at nominal rotation speed is not yet reached or respectively is fallen below. Then in operation with the centrifugal processing of the product (operating instants 3.-4.) the noise level threshold value is reached and then exceeded. This is determined with the control device, which also calculates an altered correcting variable—here an altered rotation speed. Then (operating instants 4.-5.) the control device 8 reduces the rotation speed (see also FIG. 1) down to the renewed falling below of the noise level threshold value I. This method can be readily applied e.g. in separators, in particular nozzle separators, or decanters.

Figure 4B:
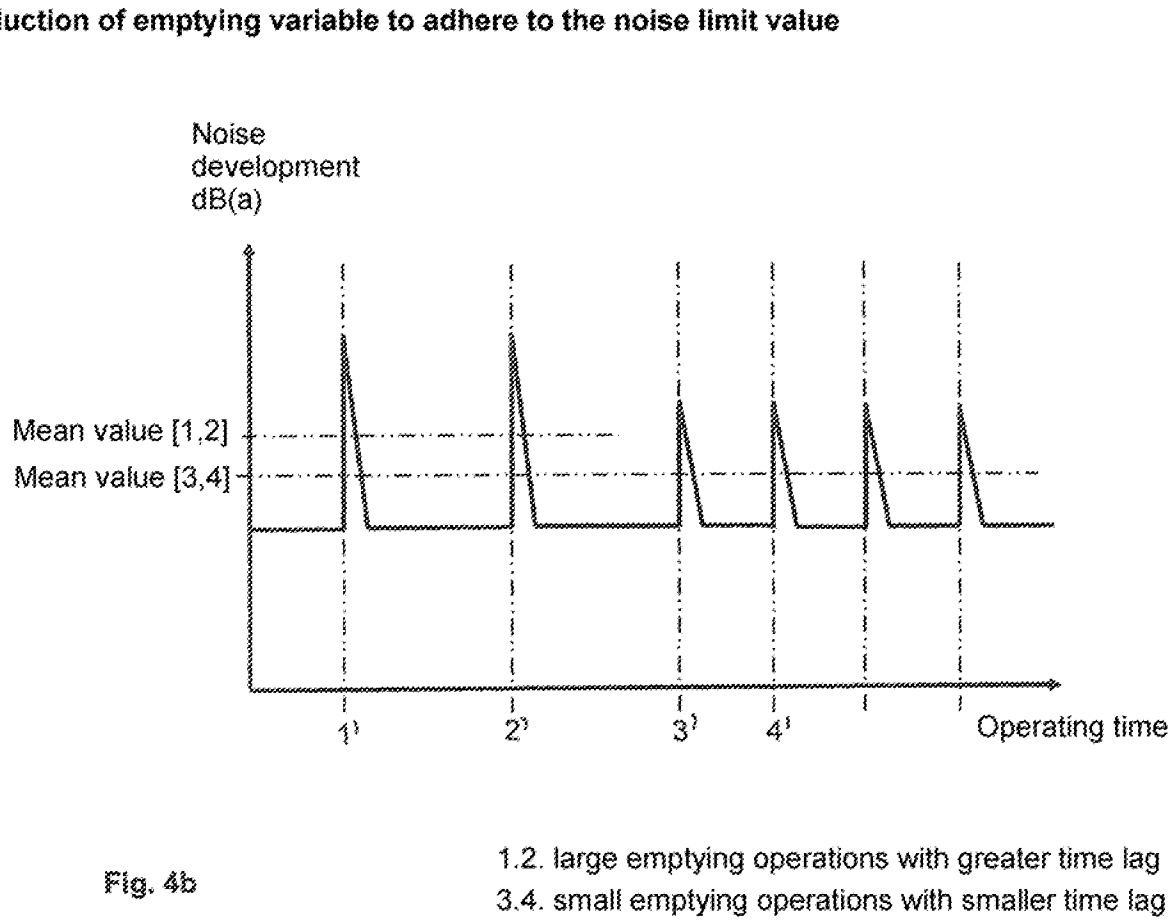

According to the variant of a method according to the invention illustrated in FIG. 4*b*, again a noise level threshold value I is to be adhered to or respectively as far as possible not or if only briefly exceeded, which, however, in contrast to in FIG. 4*a* is defined not as a peak value but rather as a mean value of the noise development. First, the thus defined noise level threshold value/mean value I is set. In operation, the structure-borne sound and/or the air-borne sound is determined for measuring the noise development of the centrifuge, and namely again preferably using a microphone or several microphones 7 as sensor device. FIG. 4*b* shows the noise development at so-called self-emptying separators, in which solids are emptied at intervals by a brief opening of solids discharge openings. With few large emptying operations (instants 1' and 2') a higher mean value occurs for the noise development than with several small emptying operations (instants 3' and 4'). In such a way, when the mean value is exceeded, the emptying amount at the outlet and the emptying frequency at the outlet 6 of the drum 1 of the separator is advantageously and simply used and if applicable altered by the control device as correcting variables.

Although the present invention has been described above by means of embodiments with reference to the enclosed drawings, it is understood that various changes and developments can be implemented without leaving the scope of the present invention, as it is defined in the enclosed claims.

REFERENCE NUMBERS drum 1
motor 2
supply line 3
discharge lines 4,5
solids discharge openings 6
microphone 7
control device 8
line 9
data lines 10, 11, 12
machine frame 13
foot elements 14
base 15
spring 16
cover 17
decanter 18
rotation axis 19

The invention claimed is:

1. A method for controlling operation of a centrifuge with a rotatable drum while clarifying of a product or in a separating of a product into different liquid phases with the drum, the method comprising:

controlling noise of the centrifuge by a. defining at least one noise level limit;

b. measuring, using a sensor while rotating the drum, noise of the centrifuge;

c. providing data measured by the sensor to a controller, wherein the controller compares the measured data to target data and determines at least one correcting variable based on the comparison; and d. controlling, by the controller using the at least one correcting variable or a plurality of correcting variables, the operation of the centrifuge so that the noise of the centrifuge does not exceed the at least one noise level limit, wherein the at least one correcting variable is outlet pressure or pressures in an inlet or in one or more outlets of the rotatable drum.

2. The method of claim 1, wherein the measured noise is structure-borne sound or air-borne sound.

3. The method of claim 1, wherein the sensor is one or more microphones.

4. The method of claim 1, wherein the sensor is at least one piezo sensor or at least one laser Doppler vibrometer.

5. The method of claim 1, wherein the sensor continuously measures the noise of the centrifuge.

6. A method of claim 1, wherein the sensor measures the noise of the centrifuge at intervals.

7. The method of claim 6, wherein the intervals are less than or equal to 1 minute.

8. A method of claim 1, wherein the at least one correcting variable further comprises rotation speed of a drive spindle of the rotatable drum.

9. The method of claim 1, wherein the at least one correcting variable further comprises processed volume flow.

10. The method of claim 1, wherein the at least one correcting variable further comprises an emptying amount at an outlet of the centrifuge.

11. The method of claim 1, wherein the at least one correcting variable further comprises an emptying frequency at an outlet of the centrifuge.

12. The method of claim 1, wherein the at least one noise level limit includes at least a first and second upper noise level limit and one of the first and second upper noise level limits is selected for controlling the centrifuge based on time of day.

13. The method of claim 1, wherein the control of the noise is combined with a turbidity control.

14. The method of claim 1, wherein the sensor measures structure-borne sounds on a cover of the centrifuge.

* * * * *